United States Patent [19]

Robbins, III et al.

[11] Patent Number: 4,765,579

[45] **Date of Patent: * Aug. 23, 1988**

[54] DEVICE FOR POSITIONALLY RETAINING FLEXIBLE TRASH BAG LINER RELATIVE TO A TRASH RECEPTACLE

[75] Inventors: Edward S. Robbins, III, 459 N. Court St., Florence, Ala. 35630; Gary T. Schwertner, St. Joseph, Tenn.

[73] Assignee: Edward S. Robbins, III, Florence, Ala.

[ * ] Notice: The portion of the term of this patent subsequent to Dec. 29, 2004 has been disclaimed.

[21] Appl. No.: 95,949

[22] Filed: Sep. 14, 1987

Related U.S. Application Data

[63] Continuation-in-part of Ser. No. 31,659, Mar. 30, 1987, Pat. No. 4,715,572.

[51] Int. Cl.[4] ..... B65B 67/04

[52] U.S. Cl. ..... 248/101; 220/1 T; 220/404

[58] Field of Search ..... 248/544, 95, 97, 99, 248/101, 152, 213.2, 213.8, 316.7, 500, 505, 359.1; 220/401, 404, 1 T

[56] References Cited

U.S. PATENT DOCUMENTS

| | | | |
|---|---|---|---|
| 545,662 | 9/1895 | Stewart . | |
| 1,157,008 | 10/1915 | Lang . | |
| 1,613,621 | 1/1927 | Oke . | |
| 1,637,656 | 8/1927 | Radcliffe . | |
| 1,736,192 | 11/1929 | Easton . | |
| 1,953,042 | 3/1934 | Cody . | |
| 2,045,094 | 9/1936 | Murch . | |
| 2,177,328 | 10/1939 | Pender . | |
| 2,186,529 | 1/1940 | Jones | 220/1 T |
| 2,533,524 | 12/1950 | Snider . | |
| 2,678,764 | 5/1954 | Carlson . | |
| 3,057,506 | 10/1962 | Wetlesen . | |
| 3,102,661 | 9/1963 | Lundquist . | |
| 3,118,560 | 1/1964 | Cornelius . | |
| 3,204,866 | 9/1965 | Brighton et al. . | |
| 3,261,545 | 7/1966 | Frazier . | |
| 3,342,368 | 9/1967 | Matry . | |
| 3,411,659 | 11/1968 | Seifert . | |
| 3,419,240 | 12/1968 | Santic | 248/359.1 |
| 3,484,011 | 12/1969 | Greenhalgh . | |
| 3,561,077 | 2/1971 | Grant . | |
| 3,648,920 | 3/1972 | Stump . | |
| 3,757,990 | 9/1973 | Buth . | |
| 3,815,778 | 6/1974 | Martin . | |
| 3,834,570 | 9/1974 | Barr . | |
| 3,870,261 | 3/1975 | McSwain . | |
| 3,893,649 | 7/1975 | Cornell et al. . | |
| 4,054,225 | 10/1977 | Frech . | |
| 4,122,973 | 10/1978 | Ahern . | |
| 4,238,868 | 12/1980 | Sternberg . | |
| 4,281,813 | 8/1981 | Garrity . | |
| 4,294,379 | 10/1981 | Bard . | |
| 4,304,379 | 12/1981 | Christensen . | |
| 4,387,924 | 4/1983 | Christensen . | |
| 4,416,197 | 11/1983 | Kehl . | |
| 4,440,321 | 4/1984 | Campbell . | |
| 4,535,911 | 8/1985 | Goulter . | |
| 4,580,688 | 4/1986 | Harris . | |

FOREIGN PATENT DOCUMENTS

| | | | |
|---|---|---|---|
| 6407850 | 1/1966 | Netherlands | 248/99 |
| 180070 | 7/1962 | Sweden . | |

*Primary Examiner*—Alvin C. Chin-Shue
*Assistant Examiner*—Robert A. Olson
*Attorney, Agent, or Firm*—Nixon & Vanderhye

[57] ABSTRACT

A trash bag liner retaining and air venting device is attachable to a trash receptacle. The device includes a rim adapted to being removably secured to a top of a trash receptacle such that an upper region of a flexible liner is drapable thereover. A locking ring is provided which receives the rim in nested relationship and thus captures the liner therebetween. Preferably, an integral hinge joins the rim and the locking ring so that the latter is capable of pivotal movements relative to the former. Thus, the locking ring and the rim are movable into and out of engagement with one another to respectively positionally capture and release the liner.

11 Claims, 3 Drawing Sheets

DEVICE FOR POSITIONALLY RETAINING FLEXIBLE TRASH BAG LINER RELATIVE TO A TRASH RECEPTACLE

CROSS REFERENCE TO RELATED APPLICATIONS

This application is a continuation-in-part of, and is related to, U.S. application Ser. No. 31,659 filed on Mar. 30, 1987, now U.S. Pat. No. 4,715,572, in the name of Edward S. Robbins, III and Gary T. Schwertner and entitled "Trash Bag Retainer And Air Venting Device", the entire disclosure thereof being expressly incorporated hereinto by reference.

FIELD OF THE INVENTION

This invention relates to the field of trash receptacles that utilize bag liners and is directed to several problems that have long existed in that field.

For example, one common problem occurs when the mouth of a bag liner is merely folded over the open end of a trash receptacle. As a result, when trash or other material is placed within the bag, the bag can be pulled either partially or completely withn the trash receptacle so that it may fail to completely hold the trash. When this happens, the liner does not protect the inside of the receptacle and the receptacle may be rendered unsanitary, particularly in cases where liquid waste is involved, so that the receptacle normally must be manually cleaned.

Another common problem with the use of conventional bag liners relates to the entrapment of air between the bag liner and the inside walls of the receptacle. In this connection, air is often trapped in this manner when the liner is first placed within the trash receptacle and the mouth of the liner is folded over the top rim of the receptacle. This entrapped air prevents the bag liner from assuming its fullest possible configuration within the receptacle and, thereby, limits the amount of trash that can be held without manual adjustment.

Yet another common problem results from the use of bag liners that are larger than the receptacle in which they are placed. In this situation, a person has two choices when placing the liner within the receptacle. First, they can tie off the mouth of the liner which results in a snug fit of the liner to the rim of the receptacle. However, this action requires some considerable effort and frequently also results in the undesired entrapment of air as described above.

Alternatively, they can merely fold the mouth of the liner over the rim. In that case, however, the liner is loose and may fall or be pulled into the receptacle, whereby it may fail to serve its intended purposes as noted above.

DESCRIPTION OF THE PRIOR ART

Many types of trash receptacles have heretofore been proposed for use in receiving flexible, collapsible trash bag liners and the like.

One approach to these problems is disclosed in U.S. Pat. No. 3,815,778 which shows a rigid trash container that receives a plastic trash bag. The bag is held in place by a retainer collar and the entrapped air is vented solely through holes in the sidewalls of the container itself. While this approach is somewhat satisfactory, the use of holes in the sidewalls or bottom of the container is not desirable since (1) these holes are not attractive to customers and (2) the presence of such holes may permit the leakage of fluids outside of the receptacle when the liner is pierced or broken. (To the same effect, see U.S. Pat. Nos. 4,281,813 and 2,678,764.)

A modification of this approach is shown in U.S. Pat. Nos. 4,054,225 and 1,157,008. There, latches are employed on the container itself so that the container can be split open to remove the plastic bags or inner containers. This is a labor intensive action requiring stooping by the user. As a result, it is not generally accepted by consumers.

Another solution is achieved through the use of a self-venting double walled receptacle. See, e.g., U.S. Pat. No. 3,118,560 This approach, however, is quite expensive and is not believed to be readily adaptable with the use of plastic bag liners.

Alternatively, air conduits can be incorporated into the sidewalls of the refuse container in order to vent air as is shown in U.S. Pat. No. 1,736,192. However, that structure employs a complicated internal grid member 15 in combination with a rotating member 17 which serve to hold the upper ends of the bag in place inside of the container.

A less complicated structure is shown in U.S Pat. No. 4,122,973. However, when the liner of the paint bucket is snapped into place, the air can no longer be vented. In addition, this reference is of only marginal relevance at best since it has a rigid, relatively thick liner.

U.S. Pat. No. 4,294,379 teaches yet another possible solution. It discloses a trash receptacle where trapped air is vented from between the trash liner and the receptacle by means of tubes along the sidewalls of the receptacle and notches placed in the upper rim of the receptacle. It fails to teach, however, any means to firmly hold the bag liner in place other than a lid 13. The problem with this lid is that its removal may pull, tear or otherwise impair the bag liner when it is in actual use. Thus, this solution is also not desirable.

A further potential approach is illustrated in U.S. Pat. No. 3,484,011 whereby an adapter or "stopper" type construction is used to hold a liner and to vent air. The liner and adapter may be an integral unit or they may be two separate units. In order to vent air, however, it is imperative that the liner not extend between the adapter and the container rim. As a result, the liner must be affixed solely to the bottom portion of the adapter. This approach is not believed to be practical in terms of trash receptacle devices.

Still another concept is disclosed in U.S. Pat. No. 1,953,042 which is directed to a bag emptying device, rather than a trash receptacle. There, a ring 25 is used as a locking device to secure a bag that is to be emptied. Handles 26 are provided so as to permit the ring to expand and contract during its placement over the rim of the container (see lines 54–62). However, there is no teaching of any means to vent entrapped air. The reason for this omission is directly related to the fact that it is a bag emptying device. Consequently, the bag is already full when the container is disposed around it and, thus, there is no concern about venting entrapped air.

Other waste receptacle related structures are shown in U.S. Pat. Nos. 4,378,924; 4,304,379; 4,238,868; 3,893,649; 3,870,261; 3,648,920; 3,561,077; 3,411,659; 3,342,368; 3,261,545; 3,204,866; 3,102,661; 3,057,506; 2,533,524; 2,177,328; 2,054,095; 1,637,656; 1,613,621; and 545,662. None of these references is believed to provide a complete solution to the problems identified above. Thus, for example, while some of these references teach various bag holding means, they fail to disclose any adequate air venting means.

BACKGROUND AND SUMMARY OF THE INVENTION

It is an object of the present invention to provide a simple device that not only firmly holds a bag liner in a trash receptacle, but, also permits the escape or venting of air entrapped between the inside wall of the receptacle and the liner.

One embodiment of the present invention is a bag retaining and air venting device having at least one channel with a generally U-shaped, V-shaped or similarly shaped interior cross-section. Within this cross-section, there are a plurality of ribs (or other forms of locking mechanisms) that, in the preferred embodiment, have a lip (or other forms of latching means) on at least one edge portion of at least some of the ribs so as to more securely engage the device onto the flange or rim of the trash container. The spaces between the ribs in the interior cross-section of the device serve as a venting means for entrapped air.

Alternatively, additional venting means can be utilized in the device itself, or in the container. For example, portions of the interior cross-section can be enlarged so as to permit enhanced venting means. In addition, air conduits or equivalent structures can be formed in or attached to the walls of the container. Furthermore, notches or scalloped edges or holes can be placed along the rim or the upper sidewalls of the container.

In another embodiment of this invention, a rim having plural ribs as briefly described above is removably engaged to the top of the trash receptacle so that air vents, or channels, are defined between the rim's inner surface and the receptacle top. In accordance with this embodiment of the invention, however, the upper portion of the flexible trash bag is draped over the exterior of the rim and is secured thereto by means of a cooperating lock ring sized and configured to accept the rim's exterior in nested relationship so as to capture, and thus positionally secure, the bag's upper portion thereto. Preferably, the rim and lock ring are joined to one another by an integral, flexible hinge so that the rim may first be positioned on the receptacle top and the lock ring may thereafter be pivotally moved into cooperating locking relationship thereto and thus provide greater convenience to the user. The rim and lock ring may, however, be provided as separate structural elements, if desired. Moreover, the lock ring itself need not be continuous, but could be fashioned in the form of separate, discrete elements which thus serve to "clip" the bag's top portion to the rim at discrete spaced intervals about the rim's periphery.

It should further be appreciated that the bag retaining and venting device of this invention can be made of any suitable material. Presently, plastic and metal materials are believed to be superior. Likewise, the shape, dimensions and thicknesses of the device can be varied to suit the particular usage such as, for example, the size of the container and whether the device is to be reusable or not.

It will also be apparent that other modifications and variations of this invention can be effected without departing from the scope or spirit of this invention as defined in the appended claims.

BRIEF DESCRIPTION OF THE DRAWINGS

Reference will hereinafter be made to the accompanying drawings wherein like reference numerals throughout the various Figures denote like structural elements, and wherein.

DETAILED DESCRIPTION OF THE PREFERRED EMBODIMENTS

The foregoing features and advantages of the present invention will become apparent with reference to the following detailed description thereof taken in conjunction with the accompanying drawings.

Figure 1:
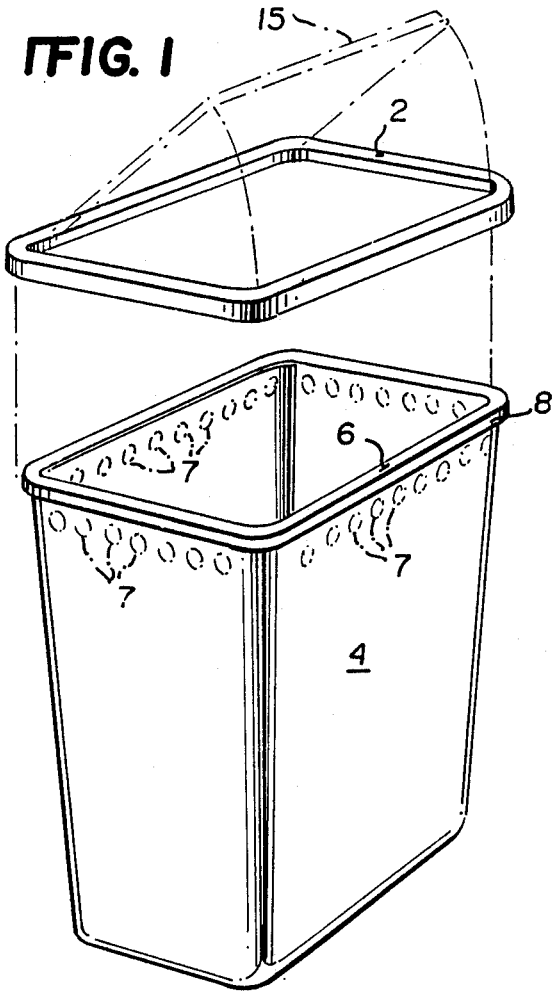
FIG. 1 is an exploded view of an exemplary embodiment of the bag retaining and air venting device according to the present invention as applied to a "standard" trash container.
Figure 4:
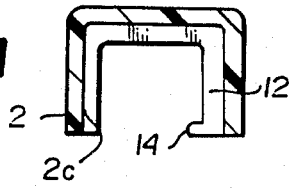
FIG. 4 is a cross-sectional elevation view taken along line 4—4 in FIG. 3.

FIG. 1 shows an exploded view of the preferred embodiment of a bag retaining and air venting device 2 along with a "standard" trash container 4 having a substantially rectangular open top end 6 defining flange 8. Rim 2 comprises a one-piece generally rectangular channel **2*a* (FIG. 2) having a generally U-shaped interior cross-sectional shape which is sized and configured to conform to the size and configuration of the top end 6 of container 4. Preferably, container 4 is of the type having solid walls, but holes (shown in dotted line in FIG. 1 by reference numerals 7**) could be formed in the upper sidewalls thereof.

Figure 2:
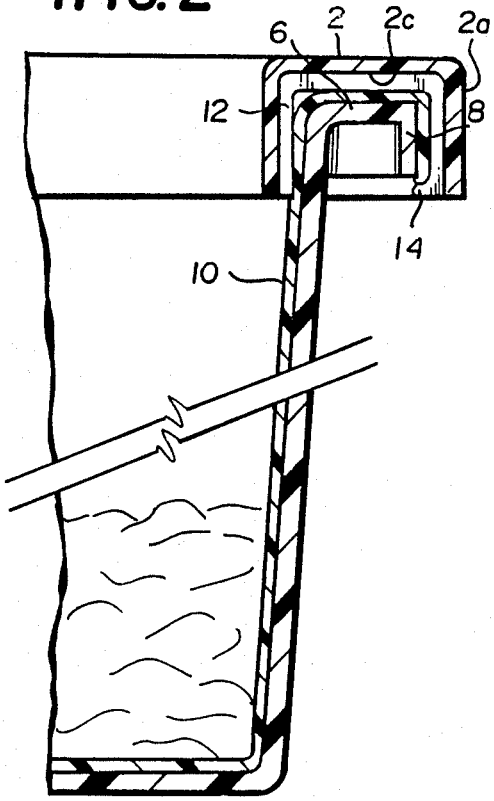
FIG. 2 is a partial cross-sectional view of the assembled trash receptacle shown in FIG. 1 depicting an exemplary embodiment of the bag retaining and air venting device and showing a flexible, collapsible trash bag liner therein.
Figure 3:
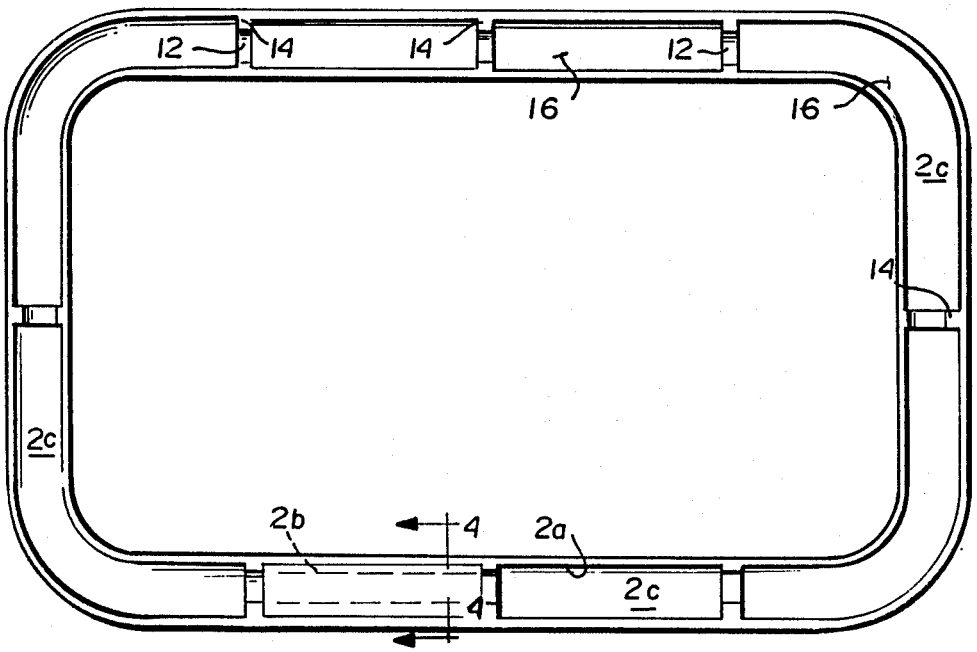
FIG. 3 is a bottom view of a preferred embodiment of the bag retaining and air venting device in accordance with the invention showing the retaining and venting means.

As shown in FIG. 2, a flexible, collapsible trash liner 10 has been inserted into the container 4 and has been folded over end 6. Liner 10 is locked into place by means of rim 2 which, as illustrated in FIG. 3, includes a plurality of U-shaped ribs 12 spaced apart and fixedly secured to (preferably, integrally formed with) the interior surface **2*c* of U-shaped channel 2*a*, i.e., in the interior cross-section of rim 2. The plurality of U-shaped ribs 12 collectively define a separate interior channel area 2*b* within channel 2*a* (shown in dotted-line form in FIG. 3) which is sized to receive the top end 6 of trash container 4 and liner 10**.

Each of the ribs 12 also preferably includes a projecting lip portion (latch) 14 that is disposed on the outside bottom edge of ribs 12. As rim 2 is positioned over end 6 of container 4, the projecting lips 14 cooperate with flange 8 in that it extends under flange 8 in order to firmly retain liner 10 between ribs 12 and end 6. It is by this means in the embodiment of FIGS. 1–4 that the liner 10 is securely held.

At the same time, spaces 16 between ribs 12 are open and, thereby, function to permit the escape of entrapped air as, for example, when trash is placed into the bag liner. Thus, liner 10 is not securely held in spaces 16 so as to allow the air to escape from between the walls of the receptacle and the liner to the outside atmosphere. That is, the ribs 12 capture a localized region of liner 10 against top end 6 of trash container 4 so that other regions of liner 10 between such captured localized regions thereof remain uncaptured, and thus capable of flexing into spaces 16 to allow air trapped between the lower portion of the liner 10 and the sidewalls of container 6 to escape therethrough.

It is also noted that a lid or cover (shown in dashed line in FIG. 1 by reference numeral 15) may be used in connection with the present invention. This lid may be fixedly hinged (as is shown in FIG. 1) or otherwise attached to rim 2. Alternatively, lid 15 may comprise a completely separate unit that is adapted to be placed over or onto rim 2.

Many variations in the present invention are contemplated and are to be included within the scope of this invention. For example, equivalent latching or retaining means to ribs 12 and lips 14 may be utilized within the interior cross-section of rim 2 so long as such structure functions to securely retain the bag liner and to vent entrapped air.

Furthermore, it can be appreciated that, while the channel of rim 2 should preferably be generally U-shaped, V-shaped, or similarly shaped so as to fixedly engage the flange 8 of the container 4, the shape and configuration of rim 2 may be of any desired design so long as rim 2 functions to securely retain the bag liner and to vent entrapped air. Thus, for example, the invention may be modified so that the air venting spaces between ribs 12 are enlarged by changing the interior and/or exterior cross-sectional configuration of rim 2.

Figure 5:
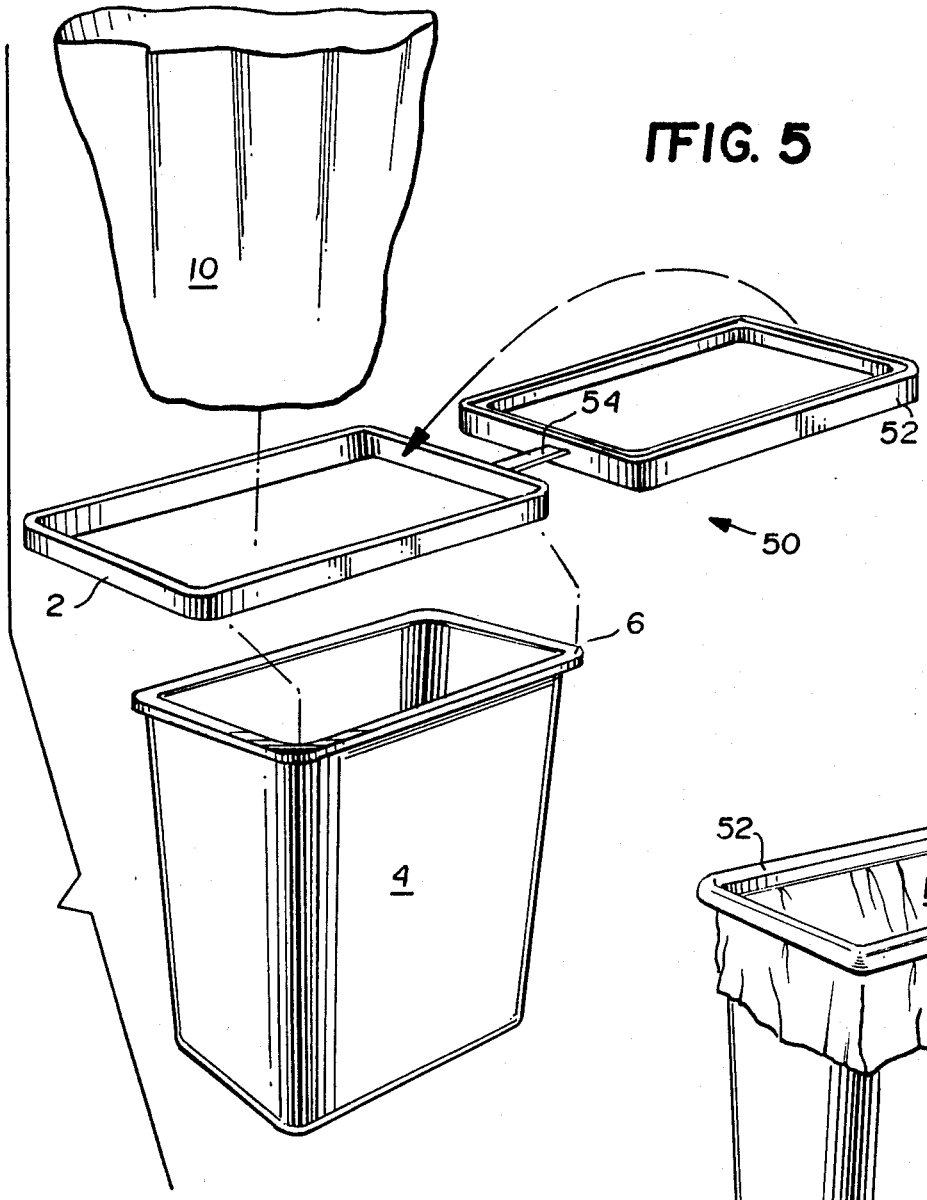
FIG. 5 is an exploded perspective view particularly showing the manner in which another embodiment of this invention removably secures a flexible trash bag liner to a trash receptacle.

Another embodiment of liner-retaining device of this invention can be seen by reference to accompany FIGS. 5–9. As is shown in FIG. 5, the liner-retaining device 50 generally includes, as a component part thereof, a rim 2 similar in construction to that described above with reference to FIGS. 1–4. Thus, a detailed description thereof will not be repeated hereinbelow. However, whereas the rim 2 of FIGS. 1–4 was adapted to capture localized regions of the flexible liner 10 between the ribs 12 and the top end 6 of container 4, the rim 2 of the embodiment shown in FIGS. 5–9 is intended to have the flexible liner 10 draped over the rim's exterior surface as is shown more clearly in FIG. 7. In order to positionally secure the liner within the container 4, there is provided a locking ring 52 which is preferably correspondingly U-shaped in configuration so that the rim 2 will nest therein. The rim 2 and locking ring 52 are formed so that a friction fit is established when the former is nested within the latter. As can therefore be appreciated, such a nested, friction fit relationship between rim 2 on the one hand, and the locking member 52 on the other hand captures, and thus positionally secures, the liner 10 therebetween. Moreover, air trapped between liner 10 and the sidewalls of container 4 is capable of escaping to the exterior environment via spaces 16 established between spaced-apart pairs of ribs 12 (see FIG. 3).

Figure 6:
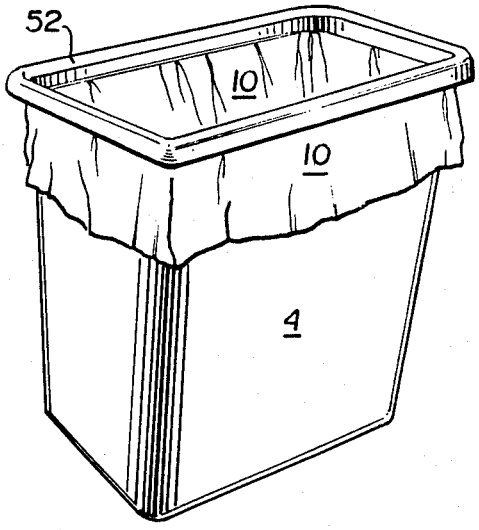
FIG. 6 is a perspective view of a flexible trash bag liner secured to a trash receptacle by means of the embodiment of the device of this invention depicted in FIG. 5.
Figure 7:
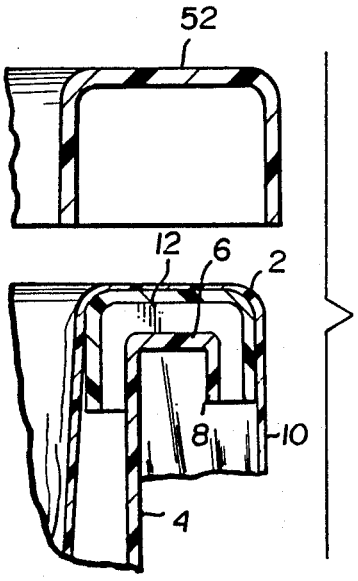
FIG. 7 an exploded partial cross-sectional elevation of the embodiment of this invention depicted in FIG. 5 and shown assembled with a trash receptacle and flexible trash bag liner.
Figure 8:
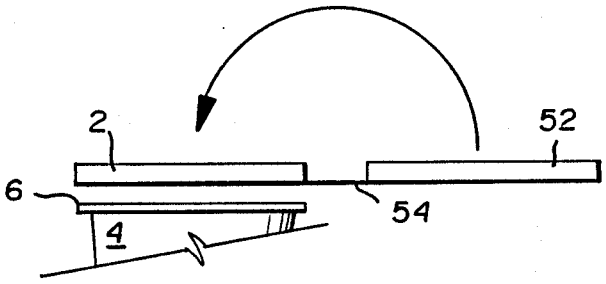
FIG. 8 is partial side elevational view particularly showing the operation of the hinge which joins the rim and lock ring of the embodiment of FIG. 5.
Figure 9:
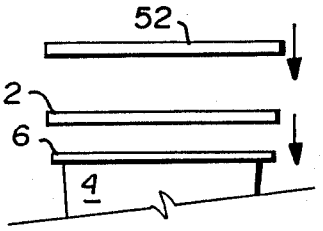
FIG. 9 is a partial side elevational view similar to FIG. 8 but showing an embodiment thereof whereby the rim and lock ring are unconnected to one another.

Preferably, the locking ring 52 and the rim 2 are interconnected by means of an integral flexible hinge 54 which permits relative pivotal movements to occur therebetween. Thus, the hinge 54 permits the locking ring 52 to pivot between a disengaged position (wherein the locking ring 52 and the rim 2 are separated from one another as shown in FIG. 8) and an engaged position (wherein the locking ring 52 and the rim 2 are in a nested relationship thereby capturing the liner 10 therebetween as shown in FIG. 6, for example). However, the rim 2 and the locking ring 52 need not be joined together by means of hinge 54 and, in fact, could be provided as separate structural elements as is shown in FIG. 9. Moreover, the locking ring 52 and/or the rim 2 need not be continuous about the periphery of the receptacle top 6 but could be provided as discrete "clips", in which case it is particularly preferred to have such discrete rims joined to the discrete locking rings by means of a hinge structure as previously described.

Finally, it is contemplated that means can be affixed to the rim to make it easier to remove it from the container. Such means can take any form necessary or desired.

While the invention has been illustrated and described in detail herein, this description is to be considered as illustrative only and not restrictive in character. It is to understand that merely the preferred embodiments have been shown and that all changes and modifications that come within the spirit of the invention are intended and desired to be protected. Thus, while the invention has been described in connection with what is presently considered to be the most practical and preferred embodiments, it is to be understood that the invention is not to be limited to these embodiments, but, on the contrary, is intended to cover various modifications and equivalent arrangements included within the spirit and scope of the appended claims.

What is claimed is:

1. A device adapted for positionally retaining an upper portion of a flexible bag liner relative to a top of a trash receptacle, said device comprising:

a rim having an inner surface which defines a cavity sized and configured to accept therein at least a part of said trash receptacle top, and an exterior surface over which an upper portion of a flexible bag liner may be draped said rim including coupling means for removably coupling said rim to said trash receptacle top; and a locking member sized and configured to lockably engage said rim so as to capture, between said rim and said locking member, said upper liner portion draped over said exterior surface of said rim, whereby said liner is positionally retained relative to said receptacle top, and wherein said rim further includes at least one pair of spaced-apart ribs, each said rib integrally formed with said rim on said inner surface thereof and projecting into said cavity defined thereby, and wherein said inner surface of said rim also establishes between said at least one pair of ribs, a channel to permit air trapped between a lower portion of said liner and a lower portion of said trash receptacle to escape to the exterior thereof.

2. A device as in claim 1 further comprising hinge means joining said rim and said locking member for permitting said locking member to be pivotally moved into locking engagement with said rim.

3. A device as in claim 2 wherein said hinge means is integral with said rim and said locking member.

4. A device as in claim 1 wherein said rim and/or said locking member are annular so as to be adapted to extend continuously around the periphery of said receptacle top.

5. A device as in claim 1 wherein said rim includes vent means for allowing air trapped between a lower portion of said liner and said receptacle to escape therethrough.

6. A trash receptacle having an open top and including means for removably retaining a flexible trash bag liner to said top, said retaining means including;

a rim having an inner surface including means for removably securing said rim to said open receptacle top about the top's periphery, and an exterior surface over which said liner may be draped; and a lock ring having an inner surface substantially enveloping said exterior surface of said rim in friction fit relationship therewith for capturing an upper portion of the trash bag liner between said inner surface of said lock ring and said exterior surface of said rim, whereby said liner is positionally secured relative to said receptacle top and wherein said rim further includes at least one pair of spaced-apart ribs each integrally formed with said rim on said inner surface thereof and projecting into said cavity defined thereby, and wherein said inner surface of said rim also establishes, between said at least one pair of ribs, a channel to permit air trapped between a lower portion of said liner and a lower portion of said trash receptacle to escape to the exterior thereof.

7. A device as in claim 6 further comprising hinge means joining said rim and said locking member for permitting said locking member to be pivotally moved into locking engagement with said rim.

8. A device as in claim 7 wherein said hinge means is integral with said rim and said locking member.

9. A device as in claim 7 wherein said rim and/or said lock ring extend continuously around the periphery of said receptacle top.

10. A device for retaining a flexible liner in position within a receptable therefor, said device including:

a rim having an interior surface defining an interior cavity adapted to being removably engageable with a top region of said receptacle and having vent means for establishing a vent which allows air trapped between said liner and said receptacle to escape therethrough to the exterior of said receptacle, said rim also having an exterior surface over which an upper region of said liner is drapable;

locking means in which said rim is nestable for capturing said upper region of said liner therebetween when said rim and said locking means are in nested relationship with one another; and hinge means interconnecting said rim and said locking means for permitting said locking means to be pivotally moved relative to said rim between (i) an engaged position, wherein said rim and said locking means are in said nested relationship thereby capturing said upper region of said liner therebetween, whereby said flexible liner is positionally retained within said receptacle, and (ii) a disengaged position, wherein said rim and said locking means are separated from one another to thereby allow said liner to be removed from said receptacle, and wherein, said vent means is established by at least one pair of spaced-apart ribs, each said rib integrally formed with said rim on said interior surface thereof and projecting into said interior cavity defined thereby, said interior surface of said rim also establishing, between said at least one pair of ribs, a channel to permit air trapped between a lower portion of said liner and a lower portion of said trash receptacle to escape to the exterior thereof, whereby said trapped air is vented.

11. A device as in claim 10, wherein said hinge means is integral with said rim and said locking means.

* * * * *